US009182720B2

(12) United States Patent
Kaneko et al.

(10) Patent No.: US 9,182,720 B2
(45) Date of Patent: Nov. 10, 2015

(54) IMAGE FORMING APPARATUS CAPABLE OF REDUCING IMAGE DENSITY IRREGULARITY

(75) Inventors: Satoshi Kaneko, Tokyo (JP); Shinji Kato, Tokyo (JP); Hitoshi Ishibashi, Tokyo (JP); Shuji Hirai, Tokyo (JP); Jun Yamane, Tokyo (JP); Koichi Kudo, Tokyo (JP); Shingo Suzuki, Tokyo (JP)

(73) Assignee: Ricoh Company, Ltd., Tokyo (JP)

( * ) Notice: Subject to any disclaimer, the term of this patent is extended or adjusted under 35 U.S.C. 154(b) by 406 days.

(21) Appl. No.: 13/591,787

(22) Filed: Aug. 22, 2012

(65) Prior Publication Data

US 2013/0108288 A1 May 2, 2013

(30) Foreign Application Priority Data

Oct. 26, 2011 (JP) ..... 2011-235277

(51) Int. Cl.
*G03G 15/00* (2006.01)

(52) U.S. Cl.
CPC ..... *G03G 15/5058* (2013.01); *G03G 15/5033* (2013.01)

(58) Field of Classification Search
CPC ..... G03G 15/5033; G03G 15/5041; G03G 15/5058
USPC ..... 399/43, 44, 49, 55
See application file for complete search history.

(56) References Cited

U.S. PATENT DOCUMENTS

| | | | | |
|---|---|---|---|---|
| 5,481,337 | A * | 1/1996 | Tsuchiya et al. | 399/46 |
| 2007/0120939 | A1 * | 5/2007 | Arai et al. | 347/132 |
| 2012/0201552 | A1 | 8/2012 | Hirai et al. | |

FOREIGN PATENT DOCUMENTS

| | | | |
|---|---|---|---|
| JP | 05232769 | A * | 9/1993 |
| JP | 06051602 | A * | 2/1994 |
| JP | 09-062042 | | 3/1997 |
| JP | 62-145266 | | 6/1997 |
| JP | 2006078889 | A * | 3/2006 |
| JP | 2006-106556 | | 4/2006 |
| JP | 3825184 | | 7/2006 |
| JP | 2008083318 | A * | 4/2008 |

* cited by examiner

*Primary Examiner* — Erika J Villaluna
(74) *Attorney, Agent, or Firm* — Oblon, McClelland, Maier & Neustadt, L.L.P.

(57) ABSTRACT

In an image forming apparatus, a processor generates a first density variation data based on the surface potential of the pattern in relation to the rotational position of the image bearer and a second density variation data based on the first density variation data and the density of the toner pattern, stores the first density variation data and the second density variation data in a memory, makes a pattern in a predetermined timing, decides whether the first density variation data is changed or not, change the first density variation data based on the decision, controls the toner image forming condition of the toner image forming device based on the first density variation data and the second density variation data.

16 Claims, 13 Drawing Sheets

BLACK TONER ATTRACTED AMOUNT DETECTOR

COLOR TONER ATTRACTED AMOUNT DETECTOR

DENSITY SENSOR OUTPUT

PHOTOCONDUCTOR CYCLE AVERAGE

THE VARIATION OF SURFACE POTENTIAL AFTER EXPOSURE (VL) IN PHOTOCONDUCTOR ONE CYCLE

THE VARIATION OF TONER ATTRACTED AMOUNT (AFTER REMOVING THE EFFECT OF THE VARIATION OF VL)

IMAGE FORMING APPARATUS CAPABLE OF REDUCING IMAGE DENSITY IRREGULARITY

CROSS-REFERENCE TO RELATED APPLICATION

This patent application is based on and claims priority pursuant to 35 U.S.C. §119 to Japanese Patent Application Nos. 2011-235277 filed on Oct. 26, 2011 in the Japanese Patent Office, the entire content of which is hereby incorporated by reference herein.

BACKGROUND

1. Technological Field

The exemplary embodiments described herein relate to an image forming apparatus, such as a copier, a printer, a facsimile machine, a printer, etc.

2. Description of the Related Art

Japanese Patent Publication No. 62-145266 (JP-S62-145266-A) describes a technology in which an image recorder (i.e., an image forming apparatus) scans a modulated laser beam onto a photoconductive drum (i.e., an image bearer) to record a latent image thereon and then applies an electro-photographic process thereto to execute development and transfer processes to obtain an output of an image. Prior to such an image output, the recorder records a solid black image on the photoconductive drum and reads the solid black image to obtain information that is read and stored in a memory to correct image density at each recording position based on the information read and stored.

Japanese Patent Publication No. 09-62042 (JA-H09-62042-A) describes an image forming apparatus that reduces density irregularity periodically occurring on an image by controlling at least one of several formation conditions including a charging voltage, a light exposure amount, a developer voltage, or a transfer voltage based on data on periodic fluctuations of image density or a charge potential on an image bearer, each of which has been previously stored. Such periodic fluctuation data used in controlling an image formation condition is measured beforehand based on a single type of image data (e.g. a solid image) in the image forming apparatus.

Japanese Patent No. 3825184 (JP-3825184-B) describes an image forming apparatus that detects a rotation cycle of a developing roller with a developing roller cycle detector and detects an amount of irregularity of toner density in a pattern formed on an image bearer. The image forming apparatus then controls a developing bias by matching a phase of an output signal from the above-described density irregularity amount detector with that of an output signal from the developing roller rotation cycle detector. Accordingly, the density irregularity of the solid image can be corrected by varying the development potential during the above-described developing bias control process executed in the image forming apparatus.

Japanese Patent Publication No. 2006-106556 (JP-2006-106556-A) also describes an image forming apparatus that forms a test image on an image bearer or a transfer medium, and detects a frequency of image density irregularity periodically occurring thereon. The image forming apparatus then identifies a source of the image density irregularity based on the detected frequency to control an operation of the source thereof to reduce image density irregularity.

SUMMARY

However, image density irregularity cannot be reduced completely by the above approaches. These image forming apparatuses make a test image, detect it, and control an image formation condition (for example, charging bias, developing bias and exposure condition) periodically based on the test image data. However, an image density irregularity changes according to the environmental conditions. As a result, an image density irregularity happens again due to a change of the environmental conditions before the next test image is produced. If decreasing an image density irregularity is needed, test images must be frequently created. This corresponds to an undesirable increase in toner consumption and unnecessary load on a cleaning unit of the image forming apparatus.

An exemplary embodiment provides an image forming apparatus, including: an image bearer; an exposing device that forms an electrostatic latent image of a pattern on the image bearer; a rotational position detecting device that detects a rotational position of the image bearer related to the pattern; an electrical potential detecting device that detects a surface potential of the pattern on the image bearer; a toner image forming device to change the pattern to a toner pattern on the image bearer; a density detector that detects density of the toner pattern; a memory that stores the density of a toner pattern and the surface potential of the pattern in relation to the rotational position of the image bearer; and a processor that generates a first density variation data based on the surface potential of the pattern in relation to the rotational position of the image bearer, generates a second density variation data based on the first density variation data and the density of the toner pattern, stores the first density variation data and the second density variation data in the memory, makes a pattern in a predetermined timing, decides whether a change in density variation has occurred, changes the first density variation data in response to the change in density variation, and controls a toner image forming condition of the toner image forming device based on the first density variation data and the second density variation data.

Another exemplary embodiment provides an image making method, including: detecting a rotational position of the image bearer; forming a latent image pattern on the image bearer; detecting a surface potential on the image bearer related to the rotational position of the image bearer; developing the latent image pattern; detecting a density of the developed latent image pattern related to the rotational position; storing a surface potential and density in a memory; generating a first density variation data based on the surface potential of the pattern in relation to the rotational position of the image bearer and a second density variation data based on the first density variation data and the density of the developed latent image, storing the first density variation data and the second density variation data in a memory, making a pattern in a predetermined timing, deciding whether a change in density variation has occurred, changing the first density variation data based on a result of deciding, controlling the toner image forming condition of the toner image forming device based on the first density variation data and the second density variation data.

Another exemplary embodiment provides a non-transitory computer readable storage medium encoded with instructions, which when executed by a computer cause the computer to execute a method including: detecting a rotational position of the image bearer; forming a latent image pattern on the image bearer; detecting a surface potential on the image bearer related to the rotational position of the image bearer; developing the latent image pattern; detecting a density of the developed latent image pattern related to the rotational position; storing a surface potential and density in a memory; generating a first density variation data based on the surface potential of the pattern in relation to the rotational position of the image bearer and a second density variation data based on the first density variation data and the density of the developed latent image, storing the first density variation data and the second density variation data in a memory, making a pattern in a predetermined timing, deciding whether a change in density variation has occurred, changing the first density variation data based on a result of deciding, controlling the toner image forming condition of the toner image forming device based on the first density variation data and the second density variation data.

BRIEF DESCRIPTION OF THE DRAWINGS

A more complete appreciation of the exemplary embodiments described herein and many of the attendant advantages thereof will be more readily obtained as the same becomes better understood by reference to the following detailed description when considered in connection with the accompanying drawings, wherein.

DETAILED DESCRIPTION

Figure 1:
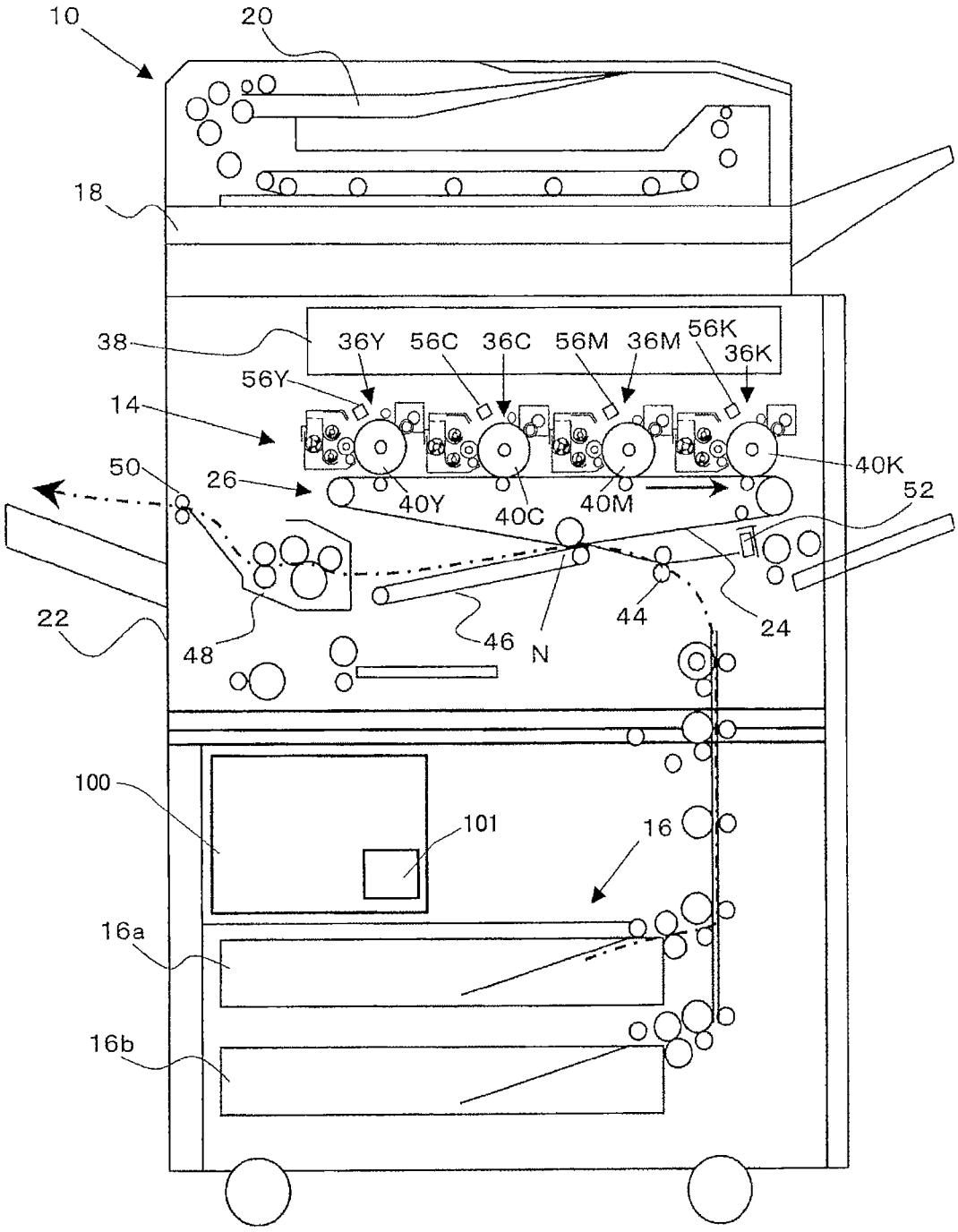
FIG. 1 is a schematic diagram showing an exemplary configuration of an image forming apparatus.
Figure 2:
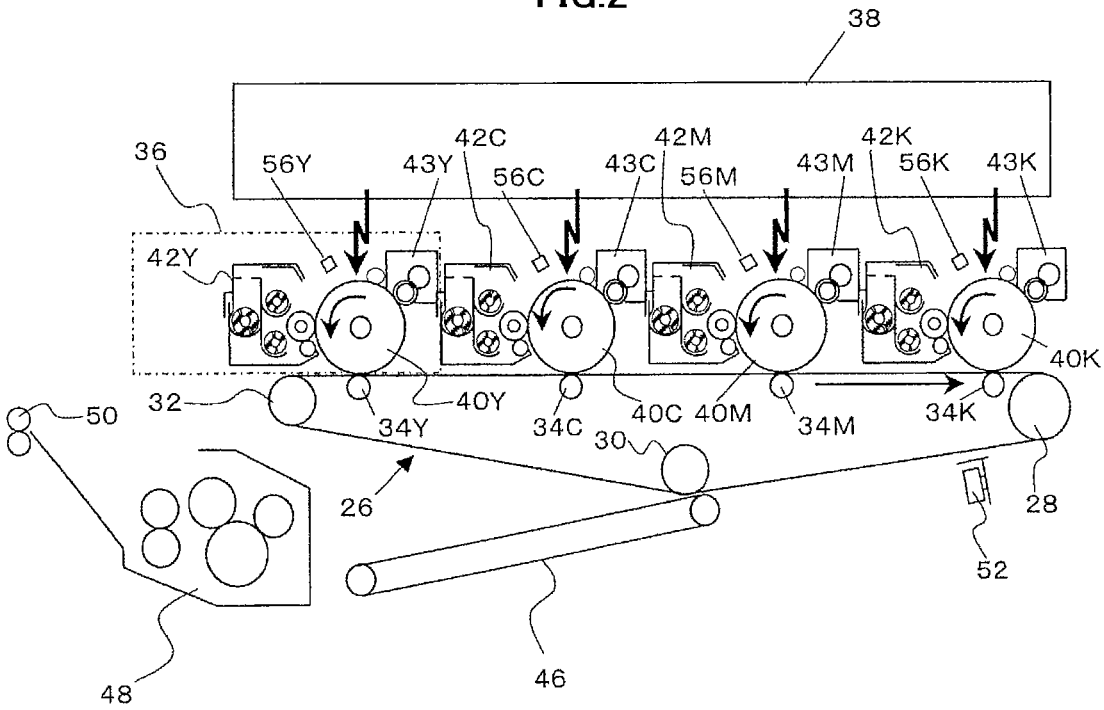
FIG. 2 is an enlarged view of an exemplary image formation section of the image forming apparatus of FIG. 1.

FIG. 1 schematically illustrates an image forming apparatus according to an exemplary embodiment, and FIG. 2 schematically illustrates an exemplary image formation section of FIG. 1. The image forming apparatus 10 has an image formation unit 14 to form an image on a recording sheet 12, a sheet supplying device 16 to supply a sheet to the image formation unit 14, a scanner 18 to read a manuscript image, and an ADF (an automatic document feeder) 20 to automatically feed the manuscript to the scanner 18 as shown in FIG. 1. The reference numerals 16*a* and 16*b* indicate sheet feeding trays 1 and 2, respectively, in FIG. 1. In the apparatus body 22, an intermediate transfer unit 26 having an intermediate transfer belt 24 stretched by multiple stretching rollers as a transfer device is disposed. The intermediate transfer belt 24 is made of material mainly composed of polyimide resin having small expansion with dispersion of carbon powder for adjusting an electric resistance thereof. The intermediate transfer belt 24 is stretched by the driven roller 28 and is endlessly driven by rotation of a driven roller 28 driven by a driving device, a secondary transfer backup roller 30, a driven roller 32, and four primary transfer rollers 34Y (yellow), 34C (cyan), 34M (magenta), and 34K (black) as well.

Above the four process units 36Y, 36C, 36M, and 36K, an optical write unit 38 as an exposing device is disposed. In the optical write unit 38, four semiconductor lasers are driven by a laser control unit and emit four writing light fluxes in accordance with image information. Drum-shaped photoconductors 40Y, 40C, 40M, and 40K, as image bearers included in the process units 36Y, 36C, 36M, and 36K, are scanned by the writing light fluxes in the dark, thereby writing electrostatic latent images Y, C, M, and K on surfaces of the photoconductors 40Y, 40C, 40M, and 40K, respectively. Surface potential sensor 56, as an electrical potential detecting device, is provided in each process unit. Surface potential sensor 56 detects a surface potential of the latent image written by the optical write unit on the photoconductor. A processor 100 controls the toner image forming condition such as a charging bias, developing bias and laser power to keep an image density within a desired level. Although it is not shown, a photo interrupter is located as a rotation position detector to detect a rotation position of the photoconductor 40 in the image forming apparatus. An example of the photo interrupter and its placement are disclosed in Japanese Patent Publication No. 2000-098675, which is hereby incorporated by reference in its entirety. Although the rotational position of the photoconductor is detected using the photo interrupter in this embodiment, the rotational position can be detected by a rotary encoder or the like.

In this embodiment, with the optical write unit 38, the laser light emitted from a semiconductor laser is optically scanned by reflecting the laser with a reflector and deflecting the laser with polygon mirror, not illustrated. However, an LED array may be used to execute optical scanning instead of the above-described device. The electrostatic latent images written on the photoconductors 40Y, 40M, 40C, and 40K are developed by toner stored in the developing device when the toner sticks to the photoconductors 40Y, 40M, 40C, and 40K due to its electrostatic attraction force. After that, toner images are sequentially superimposed on the intermediate transfer belt to form a desired image. A recording sheet is conveyed to a nip between rollers (i.e., a secondary transfer position) N constituting a secondary transfer device by a pair of registration rollers 44 at a prescribed time. The recording sheet is then subjected to a secondary transfer process in which each color component image (i.e., four color-component toner images) is transferred and superimposed on the intermediate transfer belt at once, and is further transported by a conveyor belt 46. The recording sheet passes through a fixing unit 48 and the toner image is fixed to be a color printing image, and is discharged outside a machine by a pair of sheet ejection rollers 50. Further, volatile and nonvolatile memories are installed in the image forming apparatus, in which various information, such as correction control result, executable software instructions, an output from each sensor, etc., are stored.

Figure 3A:
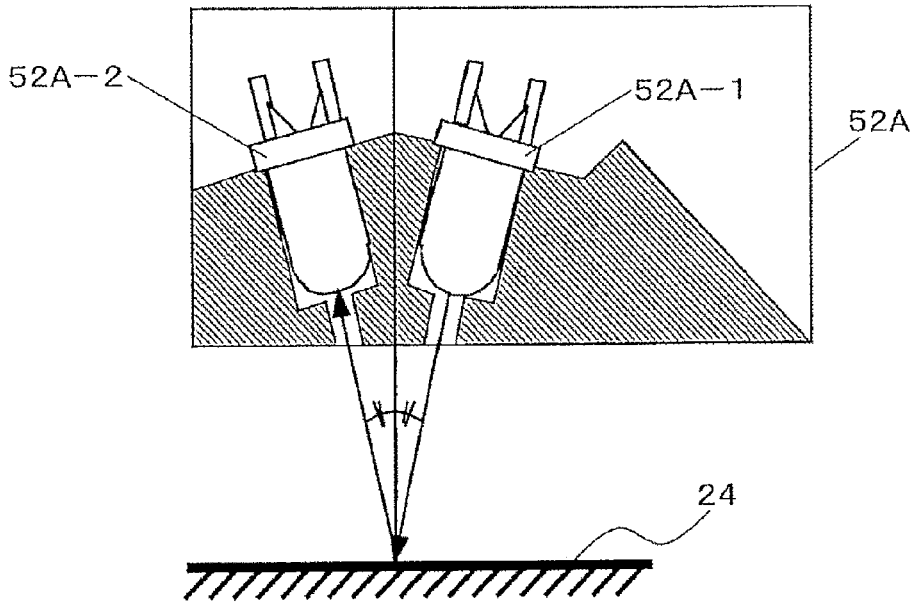
FIGS. 3A and 3B collectively show a configuration of an exemplary density irregularity detector.
Figure 3B:
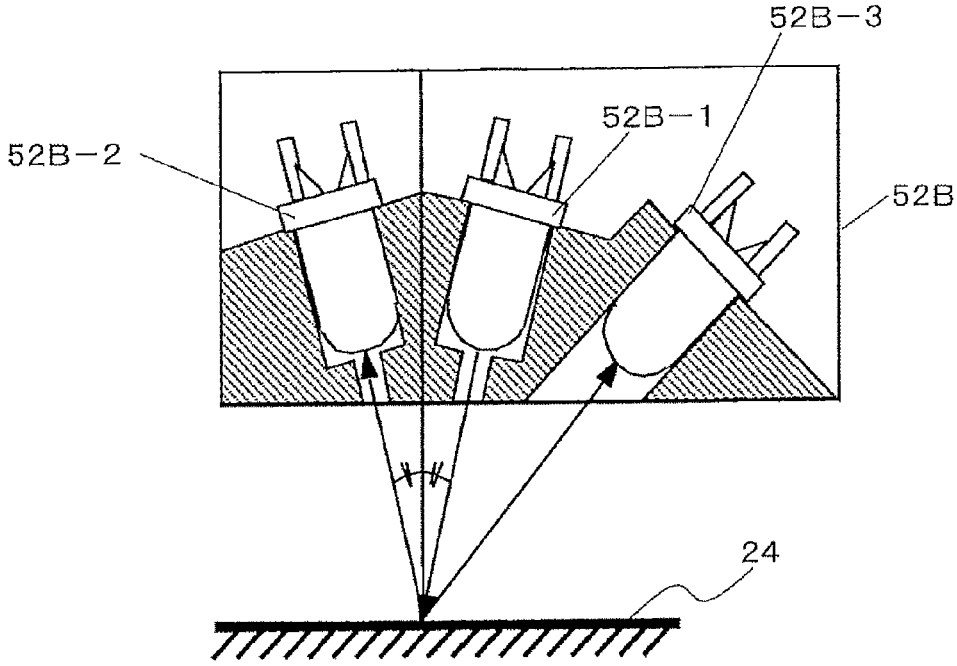

As shown in FIG. 1, a toner attracted amount detector 52, as a density detector, is positioned upstream of a secondary transfer position in a rotation direction of an intermediate transfer belt 24 to detect density of an image on the intermediate transfer belt 24. The toner attracted amount detector 52 is schematically shown in FIGS. 3A and 3B. FIGS. 3A and 3B illustrate configurations of a black toner attracted amount detector 52A and a color attracted amount detector 52B, respectively. As shown in FIG. 3A, the black toner attracted amount detector 52A is composed of a light emitting element 52A-1 formed from a light-emitting diode (LED) or the like and a light-receiving element 52A-2 receiving regular reflection light. The light-emitting element 52A-1 emits light onto the intermediate transfer belt, and the light is then reflected by the intermediate transfer belt. The light-receiving element 52A-2 receives the regular reflection light among the reflected light.

On the other hand, as shown in FIG. 3B, the color attracted amount detector 52B is composed of a light emitter 52B-1 formed from a light-emitting diode (i.e., an LED) or the like, a light receiving element 52B-2 for receiving regular reflection light, and a light receiving element 52B-3 receiving diffusion reflection light. Like the black toner attracted amount detector, the light-emitting element 52B-1 emits light onto the intermediate transfer belt, and the light is reflected by the intermediate transfer belt surface. The regular reflection light-receiving element 52B-2 receives regular reflection light among the reflected light. The diffused reflection light receiving element 52B-3 receives diffusion reflection light among the reflected light. As a light-emitting element, a GaAs infrared light-emitting diode emitting light with peak wavelength at about 950 nm is used. As a light-receiving element, a Si-phototransistor with peak light receiving sensitivity at about 800 nm is used. However, the peak wavelength and peak light receiving sensitivity can be different from those. Further, there is a distance about 5 mm (a detection distance) between the black and color attracted amount detectors and the surface of the intermediate transfer belt as a detection object. In this embodiment, the toner attracted amount detector is disposed near the intermediate transfer belt, and the image formation condition is determined based on an amount of attracted toner on the intermediate transfer belt. However, the toner attracted amount detector can be disposed above the photoconductor and a transfer conveyor belt. An output from the toner attracted amount detector is converted to an attracted amount using conventional attracted amount conversion algorithm. An example of the attracted amount conversion algorithm is included in U.S. application Ser. No. 10/798,382, which is hereby incorporated by reference in its entirety. By using this algorithm, the toner attracted amount detector becomes a developing ability measuring device.

Figure 4:
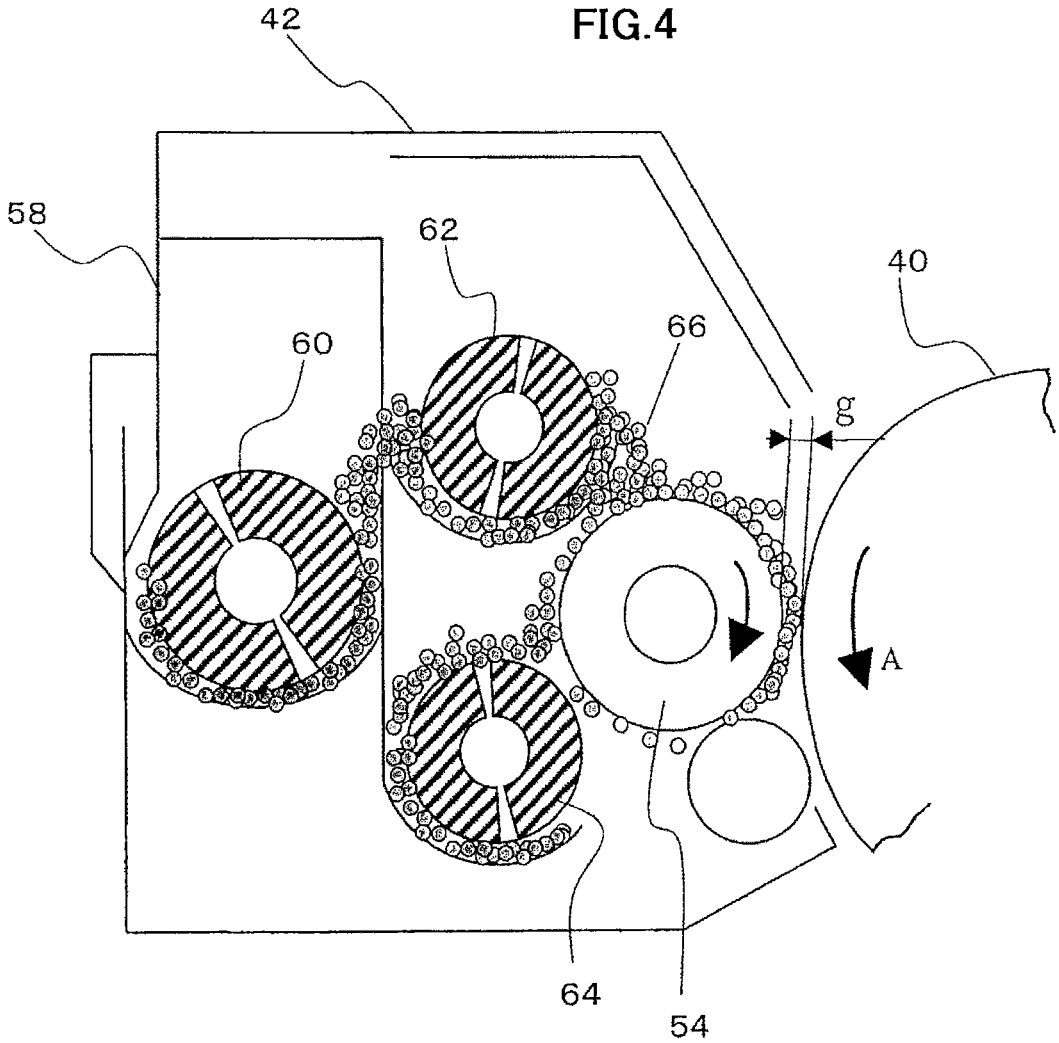
FIG. 4 is a schematic cross-sectional view of an exemplary developing device.

FIG. 4 schematically illustrates an exemplary developing device. A developing device has a developing roller 54 and three screws 60, 62, 64. The developing roller 54 is set at a distance g (called developing gap) from a photoconductor 40. The developing device 42 is faced with the drum shaped photoconductor 40. The photoconductor 40 is rotated counterclockwise as viewed in FIG. 4. Two developer components, which consist of toner and magnetic carrier, are held in the developer vessel 58 of the developing device. A stirring screw 60, a supply screw 62 and a collection screw 64 are set parallel to the developing roller in the developer vessel. The stirring screw 60 that stirs developer 66 carries the developer vertically toward the paper and carries the developer to the supply screw 62 through an aperture between both screws. The supply screw 62 supplies the developer to the developing roller 54 with stirring of the developer.

Doctor blades, not shown, regulate a height of developer supplied onto the developing rollers 54. The developer contacts the photoconductor 40 rotating in a direction as shown by an arrow in FIG. 4, and toner adheres to a latent image portion. When toner density of the developer 66 decreases, a toner replenishment unit, not shown, supplies toner to the developer vessel through an opening, not shown, formed above the stirring screw, and is stirred by the stirring screw. Although the two developer components are employed, other developers may be used.

Figure 5A:
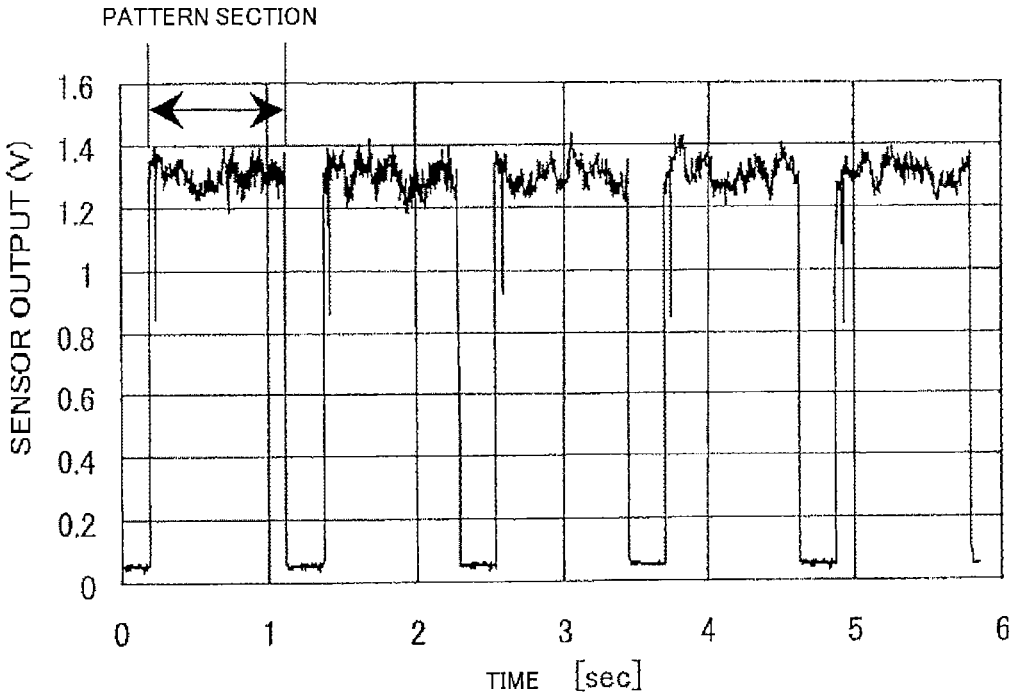
FIGS. 5A and 5B collectively show an exemplary density irregularity caused by rotation run-out of a photoconductor.
Figure 5B:
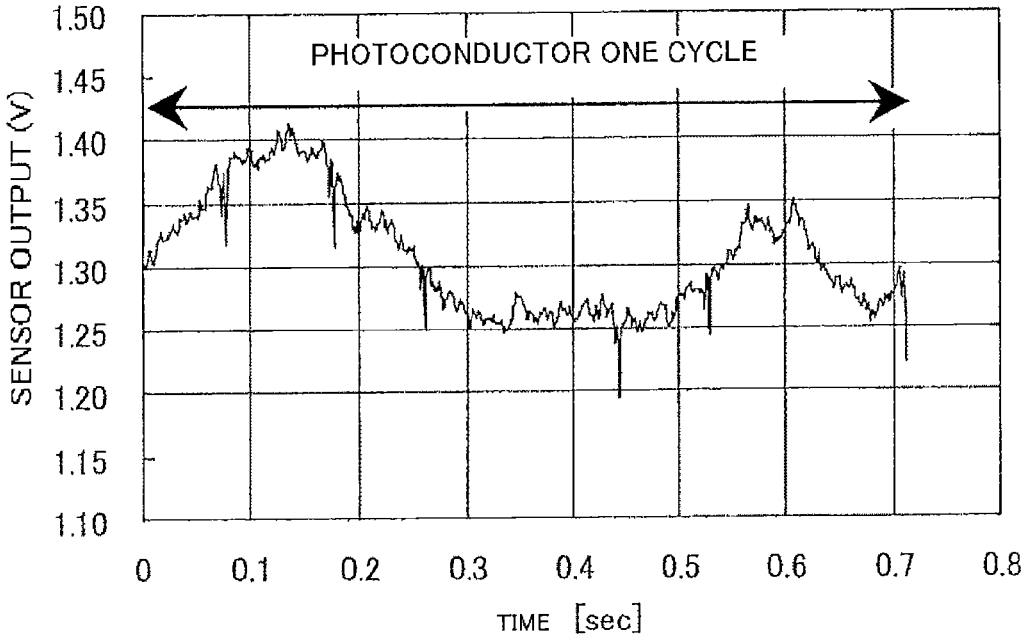
Figure 6:
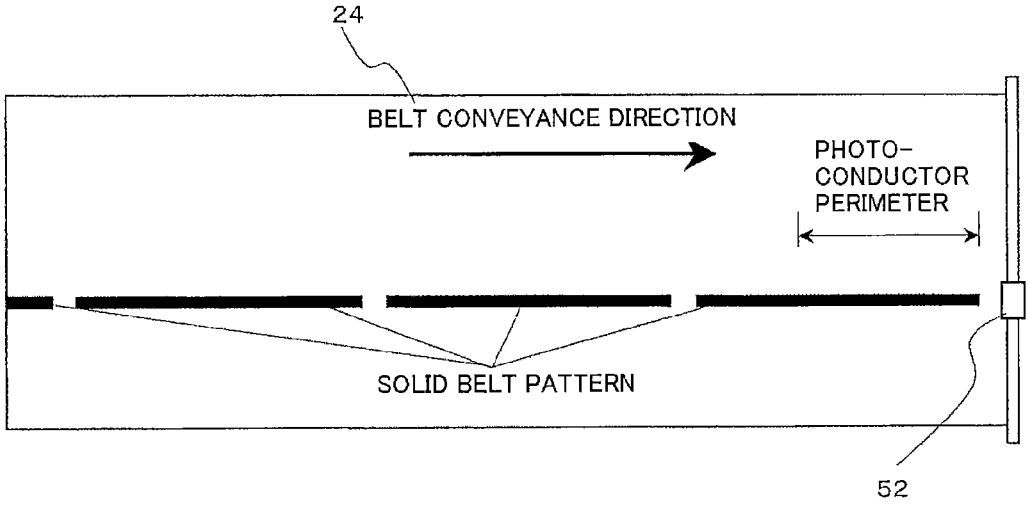
FIG. 6 is a diagram showing an exemplary belt-like solid image pattern.

Now, one example of density irregularity caused by photoconductor rotation run-out is described with reference to FIGS. 5A and 5B. Rotation run-out means the difference of radius from the center of the rotation of the photoconductor. In other words, the photoconductor is not a perfect cylinder. Photoconductor rotation run-out causes a variation in the developing gap when the photoconductor rotates. The variation in developing gap causes a variation in the electric field. As a result, photoconductor rotation run-out causes density irregularity. Initially, to confirm that density irregularity in a sub-scanning direction is caused by photoconductor rotation, an image of a slender belt-like pattern having uniform density is formed as shown in FIG. 6 by using the image forming apparatus of FIG. 1. The belt-like pattern is then measured by a toner attracted amount detector 52, which is a density sensor. As shown in FIG. 6, the belt-like pattern is sufficiently longer than the circumference of the photoconductive member in the sub-scanning direction. As an experiment, a belt-like pattern with 100% cyan is formed employing a photoconductor having a diameter of about 100 mm at a process line speed of about 440 mm/s with charging power, developing power, and LD power of about −700V, about −500V, and about 70%, respectively. FIG. 5A shows a diffusion reflection output of the density sensor. It is recognized from FIG. 5A that density fluctuation (i.e., irregularity) occurs in a pattern section. FIG. 5B is a graph showing outputs of the density sensor, i.e., density of a pattern section of FIG. 5A, extracted with reference to a detection signal of a rotational position of the photoconductor per cycle and are averaged for five cycles of the photoconductor. It is confirmed from FIG. 5B that periodic fluctuations occur in a photoconductor cycle. Since the fluctuation in the output from the density sensor represents variation of toner attracted amount, it is understood that image density fluctuates in the photoconductor cycle.

Figure 7:
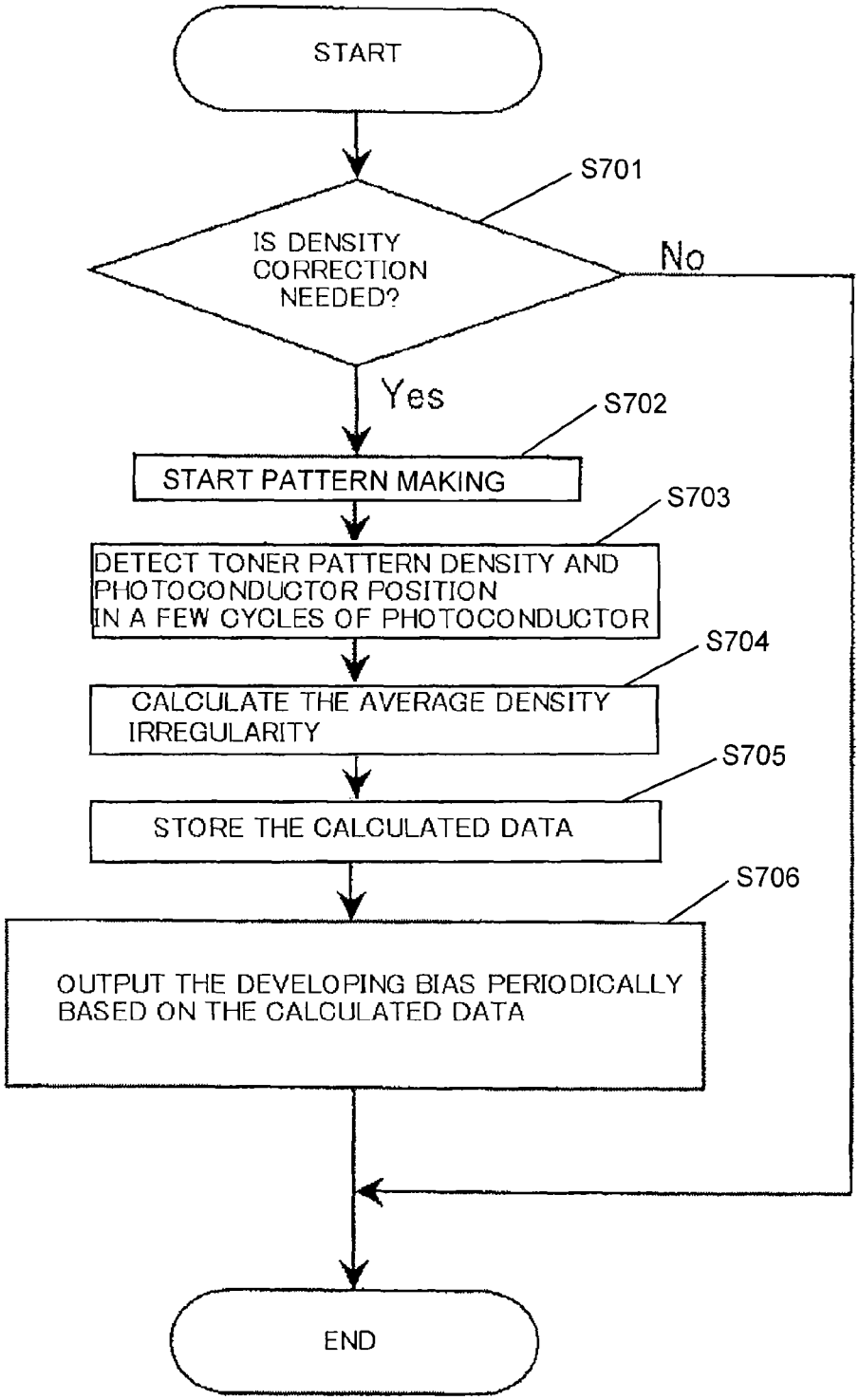
FIG. 7 is a flowchart showing conventional correction control of density irregularity using the image patterns.

Conventionally the density irregularity caused by photoconductor rotation run-out is corrected by the method shown in FIG. 7. Initially, the need of the correction is judged in step S701. When a photoconductor is changed, when a photoconductor rotational position change is detected or when the user requests the correction, the correction is needed (yes in step S701). When the correction is needed, the belt-like pattern is made on the intermediate transfer belt or on the paper in step S702, and its density irregularity is detected by the density sensor in photoconductor rotations in step S703. At the same time the rotational position of photoconductor is detected by a rotational position sensor in step S703. The detected density data is related to the rotational position of photoconductor. The data is averaged out in one rotation of the photoconductor. Then, based on the calculated average density irregularity, which is stored in a memory (steps S704 and S705), the developing bias is controlled to decrease the density irregularity. The developing bias is changed periodically based on the rotational position sensor signal and the calculated data (step S706). As a result the density irregularity caused by photoconductor rotation run-out is decreased. However, the effect is lost with time because the density irregularity changes with time.

Figure 8:
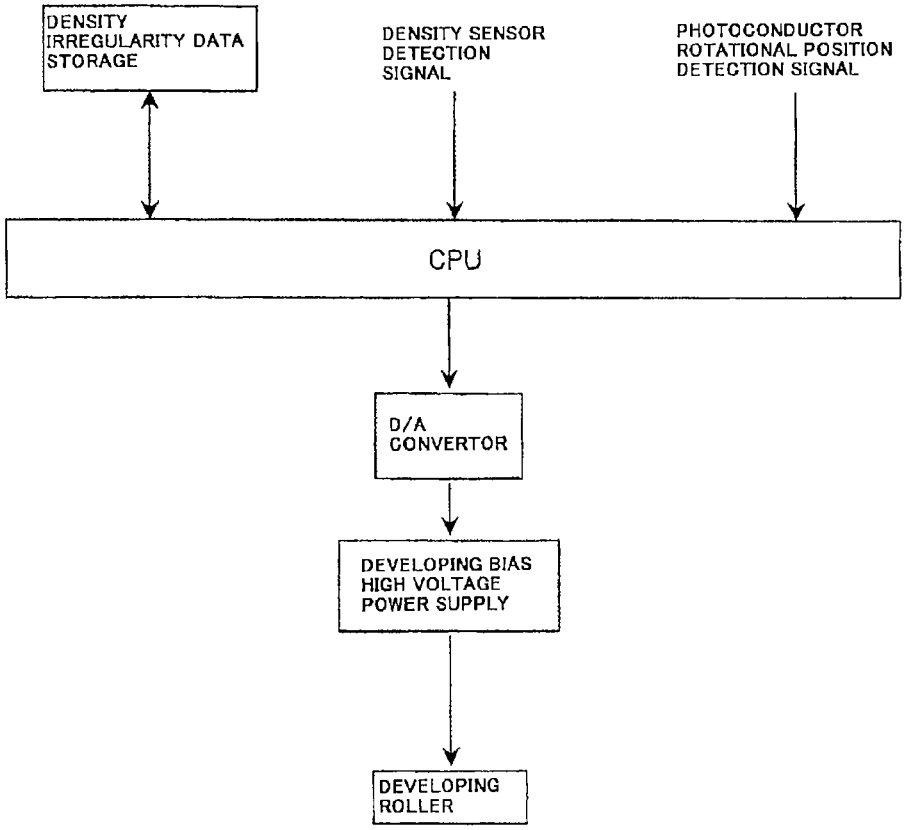
FIG.8 Prior Art
FIG. 8 is a block diagram showing a conventional method of correcting the density irregularity.

FIG. 8 is a block diagram showing a conventional method of correcting the density irregularity. Density irregularity data and its correction data are sequentially stored in a density irregularity data storage 76 as a memory when the pattern is made and detected by the density sensor and the rotational position sensor. CPU 80 generates a correction data for developing bias based on the stored density irregularity data. The correction data is outputted at the timing based on the photoconductor rotational position detection signal, transformed into an analog signal by D/A converter 83 and sent to the developing bias high voltage power supply 84. The developing bias voltage power supply 84 applies the corrected developing bias to developing roller 85 in order to decrease the density irregularity.

Figure 9:
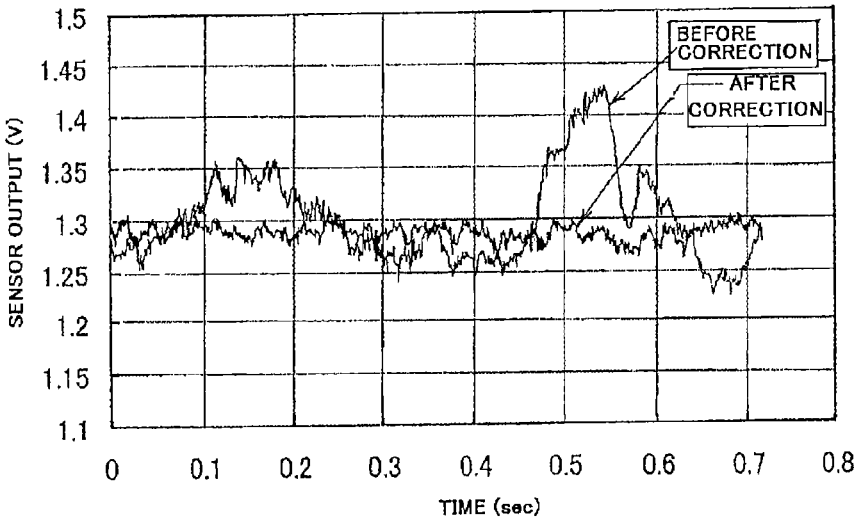
FIG.9 Prior Art
FIG. 9 is a graph showing a result of a conventional method of correcting the density irregularity.

FIG. 9 shows the result of the conventional correction method shown in FIG. 7 and FIG. 8 in the image forming apparatus shown in FIG. 1. After the correction, the density becomes almost uniform.

Figure 10:
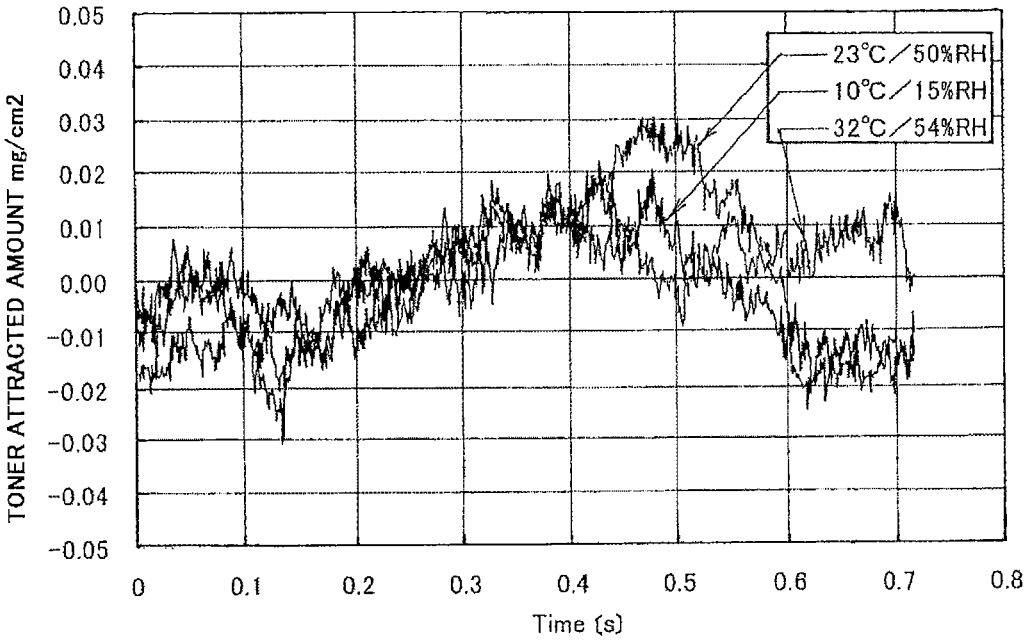
FIG. 10 is a graph showing a result of a conventional method of correcting the density irregularity in different environments.

The present inventors have found that environmental variation, in addition to photoconductor rotation run-out, is a cause of the density irregularity shown in FIG. 10. In an experiment, the same machine was used and the photoconductor rotational position was carefully kept static, and the inventors discovered that the density irregularity was different in each environment (10° C. 15% RH, 23° C. 65% RH, 32° C. 54% RH). This result means that a conventional correction method is not enough to correct the density irregularity. Further, use of a conventional correction method increases toner consumption and wastes time due to the repeated making of the toner pattern and detecting the toner pattern.

Figure 11A:
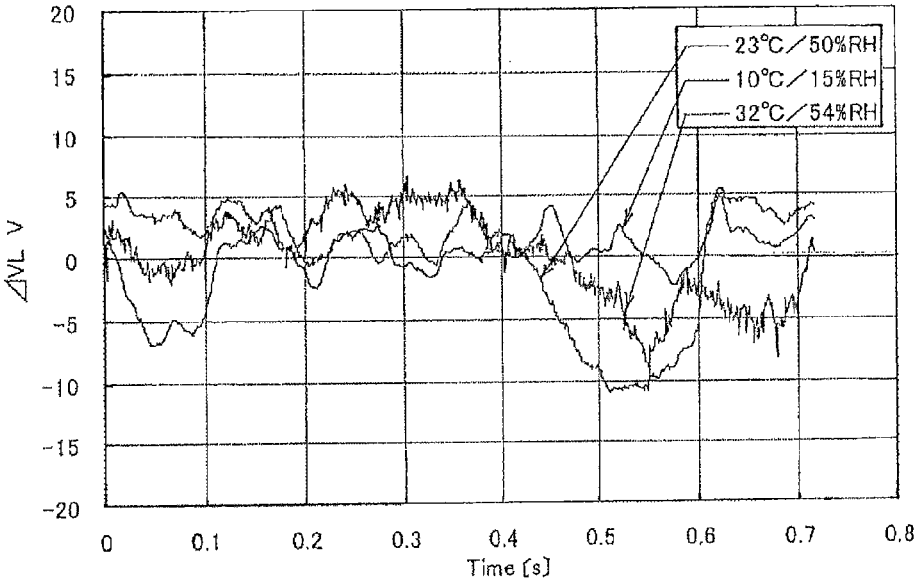
FIG. 11A is an exemplary graph of a variation of surface potential.
Figure 11B:
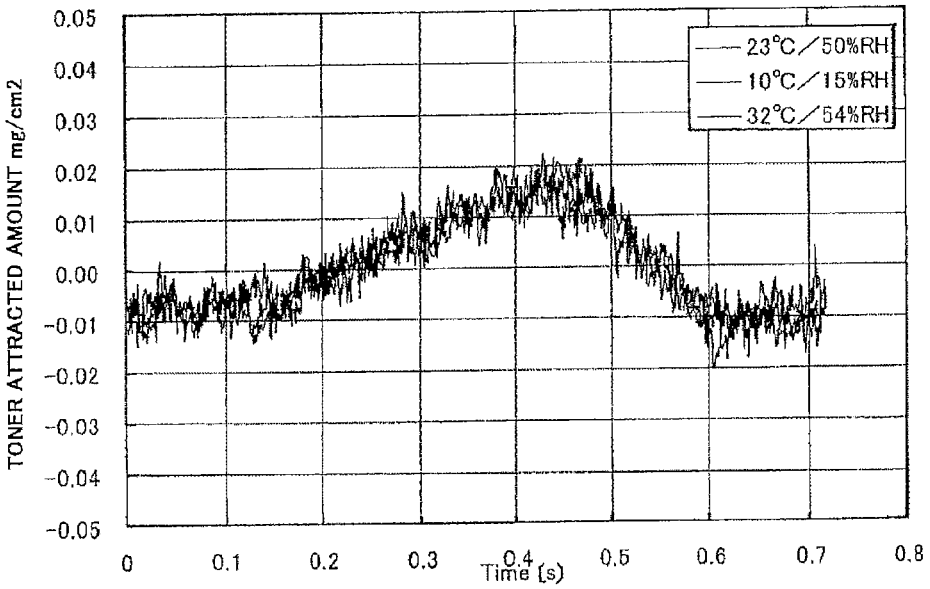
FIG. 11B is an exemplary graph of a variation of toner attracted amount after removing the effect of the variation of surface potential.

The present inventors found the above environmental variation is caused by the variation on photoconductor sensitivity. The change of photoconductor sensitivity causes the changes of the surface potential on photoconductor after exposure (VL) and the potential difference between the photoconductor and the developing roller. As a result, the change in environment causes a change of toner attracted amount developed by the potential difference. The change of photoconductor sensitivity can be clarified by measuring the surface potential on a photoconductor. The surface potential can be measured by the surface potential sensor 56. FIG. 11A shows the surface potential after exposure (VL) in each environment of FIG. 10. The surface potential after exposure (VL) is different for the different environments. The difference of the surface potential in FIG. 11A can be transformed to the difference in the amount of the toner attracted by using a development ability which is known in conventional process control. The toner attracted amount in FIG. 10 minus the above difference of the toner attracted amount from the difference of the surface potential in FIG. 11A is the one in FIG. 11B. The variation of toner attracted amount shown in FIG. 11B is substantially equal among the different environments after removing the effect of the variation of the surface potential after exposure (VL). FIG. 11 shows the variation of attracted toner caused by photoconductor rotation run-out that is independent with respect to different environmental conditions.

The variation of photoconductor sensitivity causes the variation of toner attracted amount among the different environments. It is clear that the variation of attracted toner caused by photoconductor rotation run-out does not change among the different environments. Therefore, to control image density irregularity, initially first density variation data based on the surface potential of the pattern is obtained and a density variation data detected by the density sensor minus the first density variation data becomes the second density variation data like FIG. 11B. When the toner pattern is made, the first density variation data and the second variation data are calculated and stored in a memory. The first density variation data can be obtained without making toner pattern because it can be calculated from the surface potential of the pattern. The second density variation data does not change in the environment. Thus, after toner pattern is made and the first density variation data and the second variation data are calculated and stored in a memory, only pattern surface potential is detected and only the first density variation data is calculated without making another toner pattern. The first density variation data is added to the second density variation data and stored in the memory. This sum is used in correction control to decrease the density irregularity.

Figure 12:
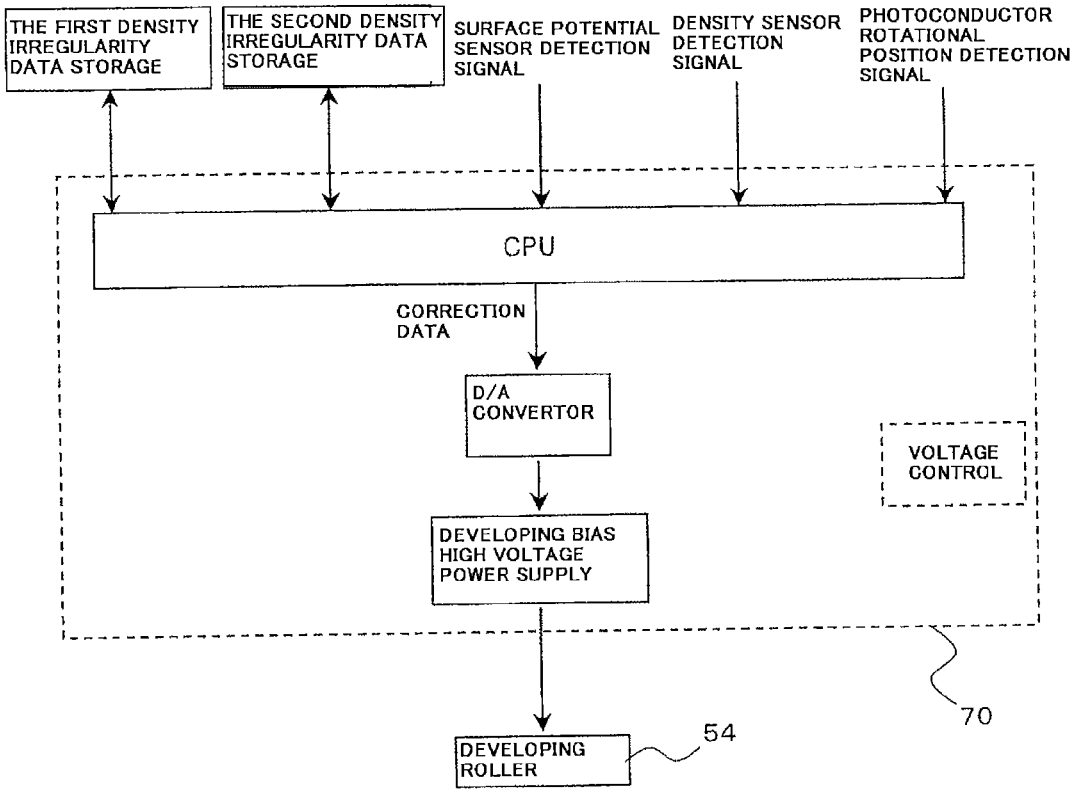
FIG. 12 is a block diagram showing an exemplary developing bias control method.

FIG. 12 shows an exemplary developing bias control device. Bias control device 70 comprises CPU, DA converter and developing bias high voltage power source. CPU receives surface potential detection signal, density sensor detection signal and photoconductor rotational position detection signal, calculates the first density irregularity data and the second density irregularity data and generates a density irregularity correction data for developing bias based on the two stored density irregularity data (elements 76A and 76B). The density irregularity correction data is outputted at the timing based on the photoconductor rotational position detection signal, transformed analog signal to the developing bias high voltage power supply by the D/A convertor. The developing bias voltage power supply applies the developing bias to the developing roller 54 to decrease the density irregularity. The first density irregularity data or the first density irregularity correction data and the second density irregularity data or the second density irregularity correction data are stored in the first density irregularity data memory 76A and the second density irregularity data memory 76B, respectively. The density irregularity correction data signal generates based on the first density irregularity correction data and the second density irregularity correction data and stored in a memory.

Figure 13:
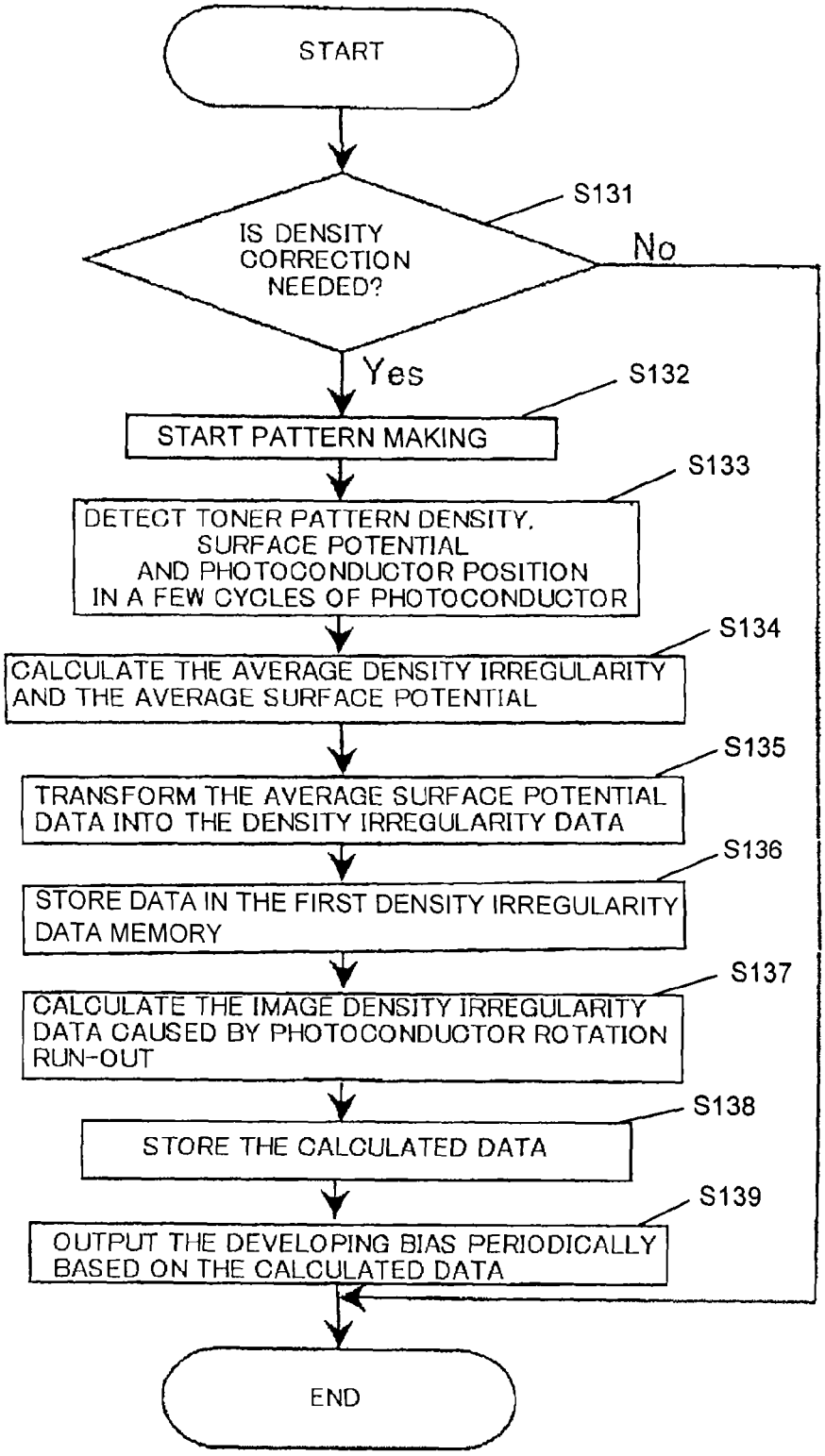
FIG. 13 is a flowchart showing an exemplary correction control method of density irregularity.

FIG. 13 shows an exemplary method of the density irregularity correction. Initially, the need of the density irregularity correction is judged (S131). Density irregularity correction is needed when a photoconductor is changed, when a rotational position of the photoconductor changes and/or when the user requests the correction. When the density irregularity correction is needed, the toner pattern (for example the pattern in FIG. 6) is obtained (S132) and its density irregularity and surface potential are detected by the density sensor and surface potential sensor (S133). The pattern can be made on the intermediate transfer belt or on the paper. At the same time, the rotational position of photoconductor is detected by a rotational position sensor (S133). The detected density data is related to the rotational position of photoconductor. The data is averaged out in one rotation of photoconductor (S134). The detected surface potential data is related to the rotational position of photoconductor. As a result, the detected surface potential data is related to the detected density data. The data is averaged out in one rotation of photoconductor like the density data (134). The averaged surface potential data is transformed into the density data as the first density irregularity data or the correction developing bias as the first density irregularity correction data (S135) and stored in the first density irregularity data memory (S136). By using one of these data, the second density irregularity data or the second density irregularity correction data is generated (S137). The above calculated average density irregularity data is transformed into the density data or the correction developing bias. The transformed data from the averaged surface potential data is subtracted from the transformed data from the above calculated average density irregularity data. Then it becomes the second density irregularity data or the second density irregularity correction data which depends on the photoconductor rotation run-out and has nothing to do with an environment (S137). The second density irregularity data or the second density irregularity correction data is stored the second density irregularity data memory (S138). All kinds of data are related to the rotational position of the photoconductor. The CPU processes the above information and changes the developing bias periodically based on the rotational position sensor signal and the data which calculated from the data stored in the first density irregularity data memory and second density irregularity data memory (S139).

Figure 14:
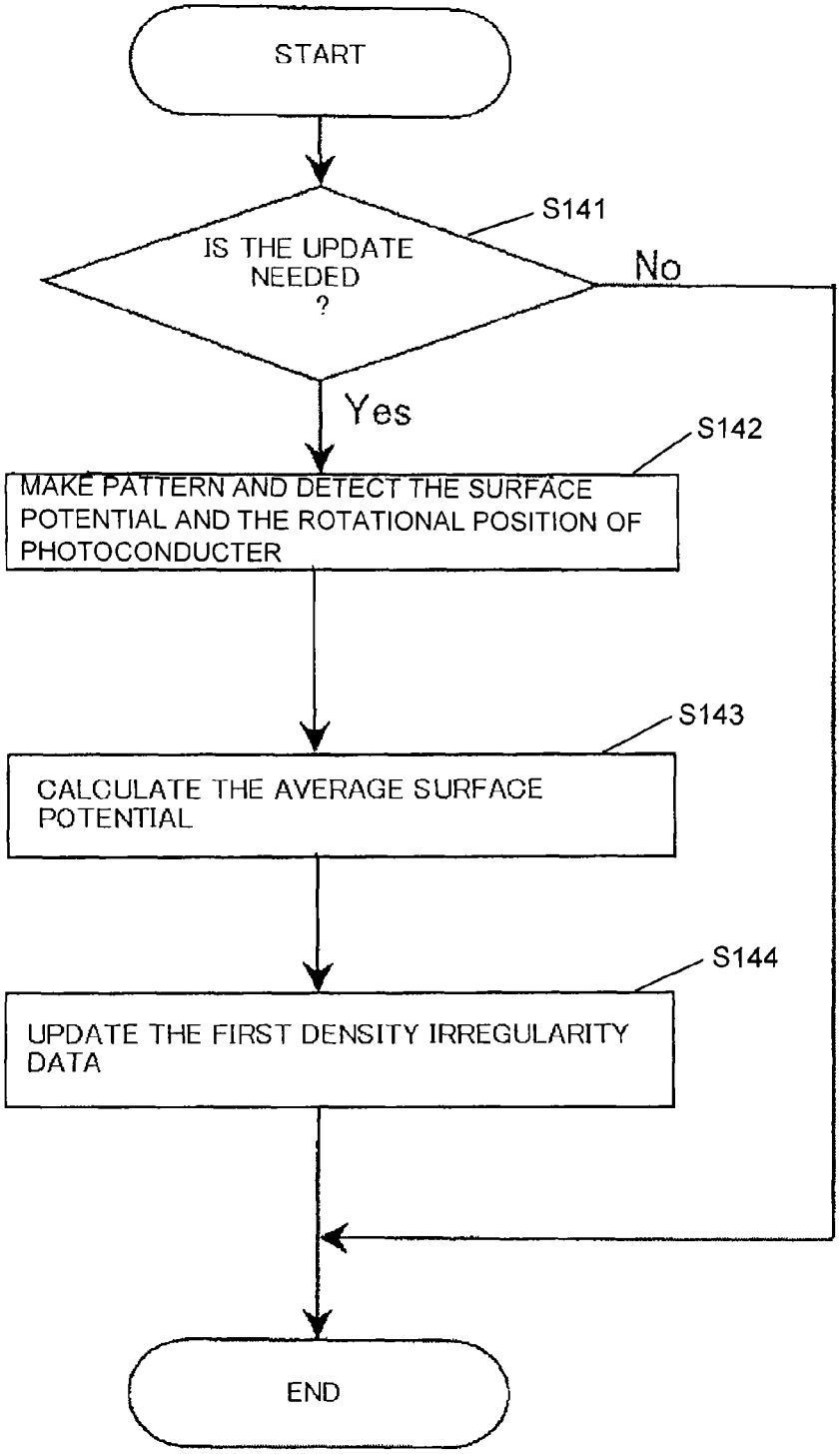
FIG. 14 is a flowchart showing an exemplary correction control method of density irregularity caused by a surface potential irregularity.

The first variation data is updated by using the exemplary method shown in FIG. 14. First, the need of the update is judged (S141). In this embodiment, the need for the update is judged by the difference between the variation data calculated from the detected surface potential and the first variation data stored in the first density irregularity data memory. When above difference is more than a predetermined value, the update is needed. In another way, the need of the update can be judged by making and detecting toner pattern. Second, a pattern for detecting first variation data is detected (S142). This step can be omitted by using the surface potential data in the first step. Surface potential is detected by the surface potential sensor in photoconductor rotations. At the same time, the rotational position of photoconductor is detected by a rotational position sensor (S142). The detected surface potential data is related to the rotational position of photoconductor. The data is averaged out in one rotation of photoconductor (S143). Then the data is exchanged with the data in the first density irregularity data memory and update is finished (S144). After the update, the updated first variation data and the stored second variation data are added, stored in a memory, used for the density irregularity correction based on the rotational position of photoconductor.

In this embodiment, the first density variation data can be updated without making toner pattern. As a result, unnecessary toner consumption is decreased. The frequency of correction can be increased. As a result, the environmental density irregularity decreases. Also, image density degrades less over time. When the pattern is made to update the first density variation data, the development bias may be changed to another value in order to prevent developing the pattern. Various kinds of data can be used as the first density variation data and the second density variation data which are stored in memories. For example, the parameter of the image forming device (ex. developing bias, charging bias, exposure light power), toner attracted amount, image density, various kinds of digital signals or the data transformed from these values. Using the appropriate transformed data can save the memory capacity. As the toner image forming condition to decrease the image irregularity, charging bias or exposing light power can be used instead of the developing bias. The update timing of the first density variation data can be set at the predetermined numbers of image making actions, at the time when the humidity or the temperature change, a photoconductor exchange timing or process control timing. The humidity or the temperature is detected by the sensor 101 on the processor 100. The update timing can be changed as the photoconductor is used. The variation of surface potential in some kinds of photoconductor decrease as its use. In such a photoconductor, the update timing frequency can be set decreased as its use. And the variation of surface potential in some other kinds of photoconductor increase when its end life is coming. In such a case, it is preferable that the update timing frequency is to an increased amount when a predetermined number of uses occur.

The image forming apparatus 10 may include at least one computer readable medium or memory for holding instructions programmed according to the embodiments discussed above, and for containing data structures, tables, records, or other data described herein. Examples of computer readable media are compact discs, hard disks, floppy disks, tape, magneto-optical disks, PROMs (EPROM, EEPROM, flash EPROM), DRAM, SRAM, SDRAM, or any other magnetic medium, compact discs (e.g., CD-ROM), or any other optical medium.

Numerous additional modifications and variations of the exemplary embodiments are possible in light of the above teachings. It is therefore to be understood that within the scope of the appended claims, the embodiments may be practiced otherwise than as specifically described herein.

What is claimed is:

1. An image forming apparatus, comprising:

an image bearer;

an exposing device that forms an electrostatic latent image of a pattern on the image bearer;

a rotational position detecting device that detects a rotational position of the image bearer related to the pattern;

an electrical potential detecting device that detects a surface potential of the pattern on the image bearer;

a toner image forming device to change the pattern to a toner pattern on the image bearer;

a density detector that detects density of the toner pattern;

a memory that stores the density of a toner pattern and the surface potential of the pattern in relation to the rotational position of the image bearer; and a processor that generates the toner pattern in a first predetermined timing, generates a first density variation data based on the surface potential of the pattern in relation to the rotational position of the image bearer in the first predetermined timing, generates a second density variation data based on the first density variation data and the density of the toner pattern in the first predetermined timing, stores the first density variation data and the second density variation data in the memory in the first predetermined timing, makes an electrostatic latent image pattern in a second predetermined timing that is more frequent than the first predetermined timing, decides whether a change in density variation has occurred, changes the first density variation data in response to the change in density variation in the second predetermined timing, and controls a toner image forming condition of the toner image forming device based on the first density variation data and the second density variation data in the second predetermined timing.

2. The image forming apparatus as claimed in claim 1, wherein the processor decides whether the first density variation data is changed or not based on the surface potential of the pattern at the second predetermined timing and the first density variation data.

3. The image forming apparatus as claimed in claim 1, wherein the processor changes the first density variation data based on the detected surface potential of the pattern in relation to the rotational position of the image bearer.

4. The image forming apparatus as claimed in claim 1, further comprising:

a developing ability measuring device that measures developing ability, wherein the processor can transform surface potential data to density data or the density data to the surface potential data based on the measured developing ability.

5. The image forming apparatus as claimed in claim 4, wherein the processor generates the first density variation data and the second density variation data as a parameter of the image forming device.

6. The image forming apparatus as claimed in claim 4, wherein the processor generates the first density variation data and the second density variation data as adhered toner quantity.

7. The image forming apparatus as claimed in claim 1, wherein the toner image forming condition of the toner image forming device is a voltage applied to a developing device of the toner image forming device.

8. The image forming apparatus as claimed in claim 7, wherein the processor changes the voltage applied to the developing device into a different voltage when the pattern passes the developing device.

9. The image forming apparatus as claimed in claim 1, wherein the processor starts the control of the toner image forming condition after a predetermined number of images are formed.

10. The image forming apparatus as claimed in claim 9, wherein the processor changes the predetermined number of images after the predetermined number is reached.

11. The image forming apparatus as claimed in claim 1, further comprising:

a detecting device that detects one or more of temperature or humidity, wherein the processor starts control of the toner image forming condition based on the detected one or more of temperature or humidity.

12. The image forming apparatus as claimed in claim 1, wherein the processor starts control of the toner image forming condition after a photoconductor of the image forming device is exchanged.

13. The image forming apparatus as claimed in claim 1, wherein the processor starts control of the toner image forming condition based on process control timing.

14. The image forming apparatus as claimed in claim 1, wherein the processor adjusts the second density variation data when the rotational position of the image bearer changes.

15. An image making method, comprising:

detecting a rotational position of the image bearer;

forming a latent image pattern on the image bearer;

detecting a surface potential on the image bearer related to the rotational position of the image bearer;

developing the latent image pattern;

detecting a density of the developed latent image pattern related to the rotational position;

storing a surface potential and density in a memory;

generating the developed latent image pattern in a first predetermined timing;

generating a first density variation data based on the surface potential of the pattern in relation to the rotational position of the image bearer and in the first predetermined timing;

generating a second density variation data based on the first density variation data and the density of the developed latent image pattern in the first predetermined timing;

storing the first density variation data and the second density variation data in a memory in the first predetermined timing;

making an electrostatic latent image pattern in a second predetermined timing that is more frequent than the first predetermined timing, deciding whether a change in density variation has occurred, changing the first density variation data based on a result of deciding in the second predetermined timing, controlling a developing condition for the latent image pattern based on the first density variation data and the second density variation data in the second predetermined timing.

16. A non-transitory computer readable storage medium encoded with instructions, which when executed by a computer cause the computer to execute a method comprising:

detecting a rotational position of the image bearer;

forming a latent image pattern on the image bearer;

detecting a surface potential on the image bearer related to the rotational position of the image bearer;

developing the latent image pattern;

detecting a density of the developed latent image pattern related to the rotational position;

storing a surface potential and density in a memory;

generating the developed latent image pattern in a first predetermined timing;

generating a first density variation data based on the surface potential of the pattern in relation to the rotational position of the image bearer in the first predetermined timing;

generating a second density variation data based on the first density variation data and the density of the developed latent image pattern in the first predetermined timing;

storing the first density variation data and the second density variation data in a memory in the first predetermined timing;

making an electrostatic latent image pattern in a second predetermined timing that is more frequent than the first predetermined timing, deciding whether a change in density variation has occurred, changing the first density variation data based on a result of deciding in the second predetermined timing, controlling a developing condition for the latent image pattern based on the first density variation data and the second density variation data in the second predetermined timing.

* * * * *